US010010785B2

(12) United States Patent
Overholt

(10) Patent No.: US 10,010,785 B2
(45) Date of Patent: Jul. 3, 2018

(54) SPOT-FOILING GAMING TICKETS AND METHOD FOR PROVIDING SAME

(75) Inventor: Brian Overholt, Albany, IN (US)

(73) Assignee: Muncie Novelty Company, Inc., Muncie, IN (US)

( * ) Notice: Subject to any disclaimer, the term of this patent is extended or adjusted under 35 U.S.C. 154(b) by 282 days.

(21) Appl. No.: 11/929,469

(22) Filed: Oct. 30, 2007

(65) Prior Publication Data

US 2008/0100056 A1 May 1, 2008

Related U.S. Application Data

(60) Provisional application No. 60/855,641, filed on Oct. 31, 2006.

(51) Int. Cl.

| | |
|---|---|
| ***A63B 71/00*** | (2006.01) |
| ***A63F 1/00*** | (2006.01) |
| ***A63F 1/18*** | (2006.01) |
| ***A63F 3/06*** | (2006.01) |
| ***B42D 15/00*** | (2006.01) |
| ***B42D 15/10*** | (2006.01) |

(52) U.S. Cl.

CPC ..... *A63F 3/069* (2013.01)

(58) Field of Classification Search

CPC ... A63F 3/06; A63F 1/00; A63F 3/069; B32B 7/12; B41F 17/00; B42C 3/00; B42D 15/00; B42D 15/02; B42D 15/10; B42D 3/00; B42D 7/00; G06K 19/06; A63B 71/00

USPC ..... 40/310; 156/64, 67, 250, 253, 277, 289, 156/290, 291; 273/138.1, 139, 269; 281/45; 283/72, 81, 98, 100, 101, 102, 283/103, 105, 901, 903; 427/157, 258, 427/288; 428/43, 195.1, 204, 207, 208, 428/209, 211.1, 212, 457, 462, 464, 465, 428/511, 915, 916; 434/119, 346; 463/16, 17

See application file for complete search history.

(56) References Cited

U.S. PATENT DOCUMENTS

| | | | | |
|---|---|---|---|---|
| 3,054,715 A * | 9/1962 | White | 156/233 | |
| 4,299,637 A * | 11/1981 | Oberdeck et al. | 283/903 | |
| 4,993,753 A * | 2/1991 | Weeks | A63F 3/0665 | 283/102 |
| 5,386,985 A * | 2/1995 | Paris | A63F 3/0665 | 273/139 |
| 5,743,524 A * | 4/1998 | Nannicola | A63F 3/069 | 273/139 |
| 6,234,536 B1 * | 5/2001 | Pittman | A63F 3/0665 | 283/101 |
| 6,443,494 B1 * | 9/2002 | Lieberman Zadjman | B41M 3/14 | 283/101 |
| 6,758,936 B1 * | 7/2004 | Kiekhaefer et al. | 283/70 | |
| 6,916,047 B2 * | 7/2005 | Jarvis et al. | 283/102 | |

* cited by examiner

*Primary Examiner* — Charles A Fox
*Assistant Examiner* — Justin V Lewis
(74) *Attorney, Agent, or Firm* — Barnes & Thornburg LLP

(57) ABSTRACT

A gaming ticket and method for providing the same includes foil applied to the gaming ticket surface such that the foil covers less than the entire surface of any surface of the gaming ticket.

26 Claims, 4 Drawing Sheets

SPOT-FOILING GAMING TICKETS AND METHOD FOR PROVIDING SAME

This application claims priority to and the benefit of U.S. Provisional Patent Application Ser. No. 60/855,641, filed Oct. 31, 2006, entitled SPOT-FOIL GAMING TICKETS AND METHOD FOR PROVIDING SAME, the entirety of which is hereby incorporated by reference.

FIELD OF THE INVENTION

The present invention relates generally to gaming tickets, and more specifically to gaming tickets with selective foil and method for selectively providing the foil.

BACKGROUND AND SUMMARY OF THE INVENTION

Various forms of gaming tickets for use in games of chance are known in the art. Examples of such gaming tickets and methods of production are found in the following United States patents, the disclosures of which are now expressly incorporated herein by reference: commonly owned U.S. Pat. No. 6,921,071; U.S. Pat. No. 5,783,010; U.S. Pat. No. 5,582,888; U.S. Pat. No. 3,956,049; and U.S. Pat. No. 3,940,124.

In addition to gaming tickets, there exists a gaming product known as Flare Cards, an example of which is depicted in FIG. 1. Such a Flare Card 10 and some gaming tickets have exposed foil portions designed to catch the attention of a potential player. There also exists a combination Flare/Seal Card known to those skilled in the art. Turning to the example of a Flare Card, a Flare Card illustratively may be displayed behind a counter at a convenience store as an advertisement to potential players to play the advertised game. These Flare Cards are produced by non-selectively laminating an entire foil sheet to an entire piece of paper stock of generally equally and co-extensive dimensions. For example, an 8.5 inch by 11 inch piece of foil and an 8.5 inch by 11 inch piece of paper are laminated together. The 8.5 inch by 11 inch area comprised of foil is the obverse side on which any desired combination of letters, numbers, colors and/or designs will appear, whereas the reverse or paper side of the laminate will generally be devoid of such markings. The entire surface area of the obverse side or surface of the Flare Card laminate is entirely comprised of foil. Thereafter, portions of the foiled area are blocked, by for example printing of graphics 17 or shading 18, in order to end up with foil visible in only selective portions 15 of the foiled side. Consequently, portions of the foil covering substantially all of the area of at least one of the surfaces of the Flare Card are masked such that they cannot be viewed by a potential player. Indeed, the masked portions 17, 18 illustratively could exceed to a great degree the unmasked foiled portions. The unmasked foiled portions 15 typically grab the attention of potential players. Similarly, gaming tickets with foil have at least one surface whose area completely comprises foil, which is subsequently masked to form selective foil graphics.

Illustratively, gaming tickets, such as for example and without limitation a seal card, an instant winner card, and/or a combination flare/seal card are produced by laminating together two or more pieces of paper stock. For example, a first piece of paper stock may comprise a gaming piece having gaming information or designs printed on an obverse side (FIG. 2) thereof and characters comprising "play combinations" or gaming combinations printed on the reverse or "game face" side thereof (FIG. 3). The gaming piece may have foil laminated thereto. A second piece of paper stock or Bristol may comprise a series of perforated openings or windows cut thereon. The windows may have characters printed on the obverse side and may be black or darkened Bristol on the reverse side in order to render the covering piece opaque. The first and second pieces of paper stock are laminated together such that each gaming combination corresponds to a perforated opening or window. Illustratively, a player pulls open a perforated opening in order to reveal the gaming combination corresponding to that opening. The printed graphics or shading on the gaming piece and the black or dark coating on the concealing piece prevent a player from viewing the gaming combination prior to opening the perforated window. Use of foil on either or both the gaming piece and the covering piece can also mask the gaming combination. Gaming tickets are regulated by various statutes and regulations and the illustrative invention will comply with and such statutes and regulations in force as of the filing date of the application.

Foil may be selectively deposited on a portion of a gaming ticket for aesthetic value. Gaming tickets with selective use of foil are designed to differentiate themselves from tickets without foil. The more aesthetically pleasing gaming ticket will be more desirable than gaming tickets lacking foil. Selective use of foil may also be cheaper than having one or more surfaces of a gaming ticket, such as for example and without limitation a pull tab gaming ticket, or a Flare Card known to those skilled in the art comprised entirely of foil, which may thereafter be masked to form the desired foil graphics. Illustratively, this selective use of foil, or spot-foil, may be either on the gaming piece, the covering piece, or both as desired and may also be used on the Flare Card, which is typically complementary to and serves to provide information on the corresponding game of chance.

The present invention may comprise one or more of the features identified in the various claims appended to this application and combinations of such features, as well as one or more of the following features and combinations thereof.

A gaming ticket comprising a gaming piece having a gaming combination is disclosed. The gaming combination may be concealed by a covering piece. The gaming piece and the covering piece may be laminated together. The covering piece may define a window which a user may peel or pull back to reveal the gaming combination. Foil may be selectively deposited on a portion of the gaming ticket.

Illustratively, for example, the gaming ticket may include a plurality of foil portions coupled to the gaming piece and/or the covering piece. The foil portions may be coupled to either the obverse side and/or the reverse side of the gaming piece and the covering piece. The foil portions may be spaced-apart from each other. The gaming ticket may also include adhesive applied to the obverse side of the gaming piece and/or the covering piece. The foil portions are positioned on the adhesive. Illustratively, the adhesive is UV glue. In other embodiments, the foil portions may each include a heat-activated adhesive agent.

According to another aspect of the present disclosure, a gaming ticket includes a gaming piece having a gaming combination, a covering piece coupled together with the gaming piece to conceal the gaming combination, and a foil portion coupled to the gaming piece and/or the covering piece. The foil portion is smaller than the surface area of each of the gaming piece and the covering piece. Illustratively, generally the entire foil portion is visible to a user. In other words, the foil portion is not masked by other portions of the gaming ticket. The foil portion may also be positioned to obscure the gaming combination. Further, the gaming ticket may include a second foil portion which is also smaller than the surface area of the gaming piece and the covering piece. The gaming ticket may also include a varnish applied to an obverse side of the gaming piece.

According to still another aspect of the present disclosure, a method of producing a gaming ticket includes applying foil to a portion of the gaming ticket. The foil may selectively be applied to one or more portions of the gaming ticket. Illustratively, each portion of the gaming ticket to which the foil is applied is smaller than the surface area of the gaming ticket. The foil may be applied to an obverse side of the gaming ticket.

Further, adhesive may be applied to a portion of the gaming ticket that is smaller than the surface area of the gaming ticket. The foil is then applied to the adhesive and the adhesive may then be cured. Illustratively, the adhesive comprises UV glue. Further illustratively, varnish may be applied to one or both sides of the gaming ticket. The covering piece and the gaming piece may be laminated together and the foil may be applied to a portion of the gaming ticket after laminating the covering piece and the gaming piece together.

Illustratively, a heat-activated adhesive contained within the foil may be activated in order to adhere the foil to the portion of the gaming ticket. Further, activating the adhesive may include heating a die to approximately 250° F. and pressing the heated die against the foil and the portion of the gaming ticket.

These and other objects of the present invention will become more apparent from the following description of the illustrative embodiment.

DESCRIPTION OF THE ILLUSTRATIVE EMBODIMENTS

Figure 1:
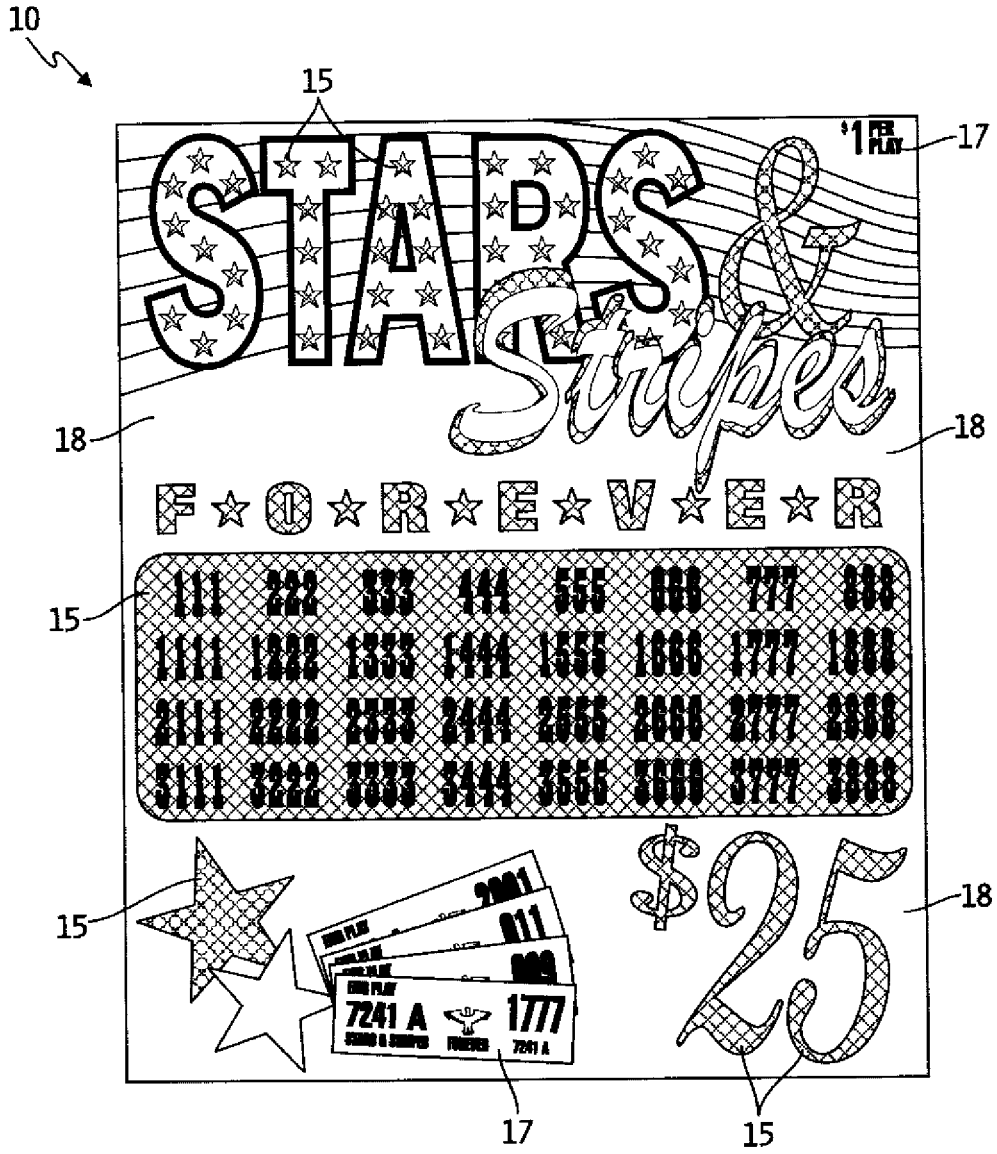
FIG. 1 depicts an illustrative Flare Card.

For the purposes of promoting an understanding of the principles of the invention, reference will now be made to a number of illustrative embodiments illustrated in the drawings and specific language will be used to describe the same.

Figure 9:
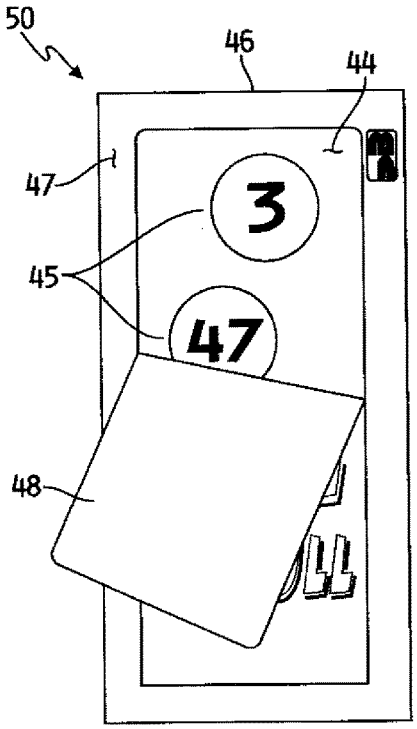
FIG. 9 depicts an illustrative gaming ticket comprising the gaming piece and the covering piece of FIGS. 6-8.

One illustrative embodiment depicted in FIGS. 6-9 comprises a gaming piece 40 and a covering piece 46. The gaming piece 40 illustratively comprises an obverse side or game face 42 and an opposing reverse side 44. Illustratively, the obverse side 42 contains any combination of desired characters, letters, numbers, symbols, pictures or other desired items collectively referred to as graphics that may for example explain, advertise, or promote the particular game. Portions of the graphics may be foil 15, portions may be ink as part of a graphic(s) 17 and portions may be shading 18. The reverse side 44 comprises a gaming combination 45. The obverse side 47 of the covering piece 46 has a window 49A defined by perforations 49 that a user or player can pull or peel back. The gaming piece 40 and the covering piece 46 illustratively are laminated together to form the gaming ticket 50, with the covering window 49A corresponding to the gaming combination 45 underneath as best seen in FIG. 9.

Illustratively, a cold method of applying foil comprises applying an adhesive to selective portions of any surface 42, 44, 47, 48 of the gaming ticket 30, 50 such that any foil applied thereafter will adhere only to those portions where the adhesive has been deposited.

In addition to the just described "cold" method of applying foil, there also exists a "hot" method of applying foil. Illustratively, the "hot" method comprises heating an alloy die to approximately 250 degrees Fahrenheit and pressing the heated die against first the foil, and then the game piece. The heated die activates an agent, for example and without limitation an adhesive agent. Such adhesive agent illustratively may be contained within the foil. It will be appreciated that the adhesive agent could also be contained within the gaming piece, or be applied to either of the foil or the gaming piece. In any event the adhesive agent adheres together the foil and the selected portion of the gaming piece or any other portion of the gaming ticket.

Figure 2:
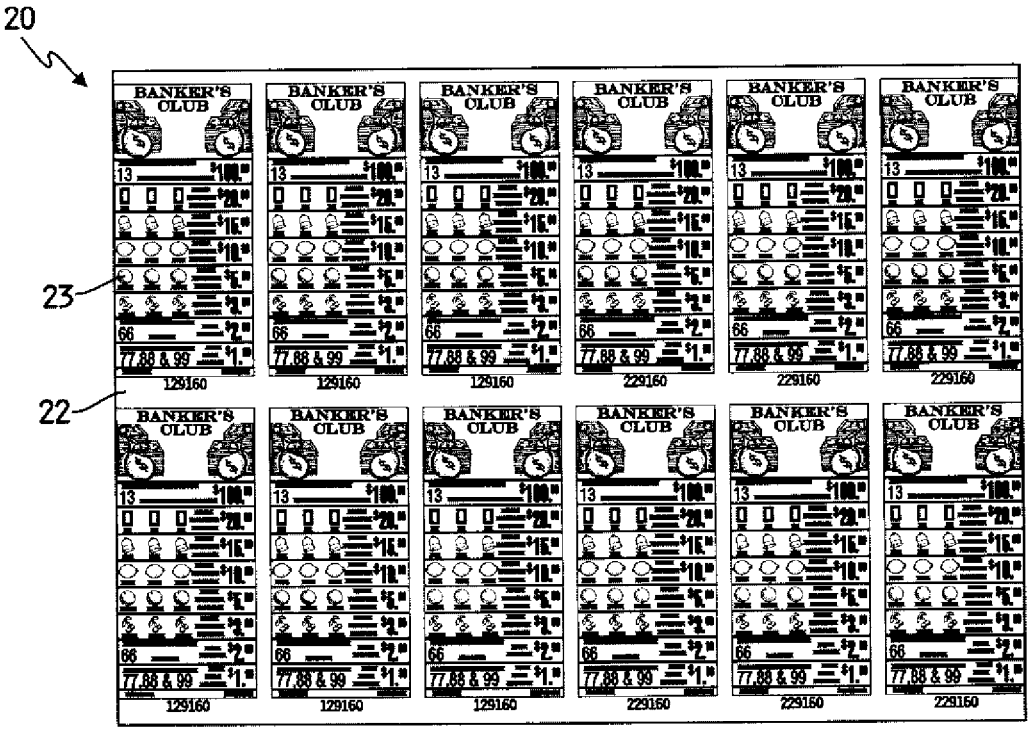
FIG. 2 depicts an illustrative obverse side of a gaming ticket gaming piece.
Figure 3:
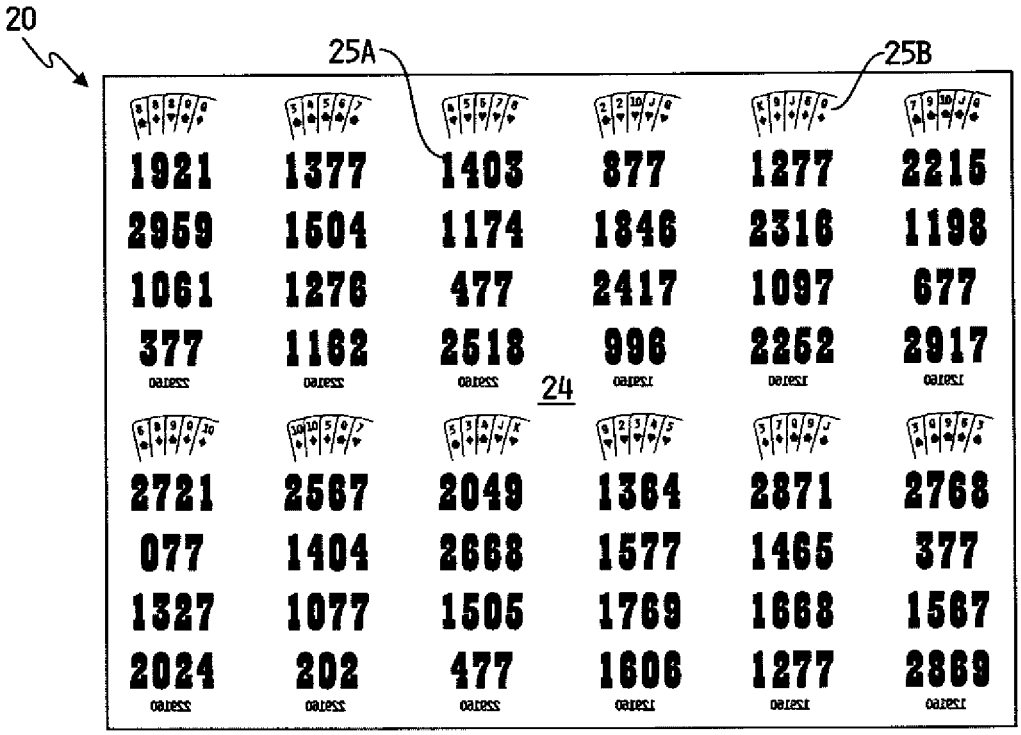
FIG. 3 depicts an illustrative reverse side of the gaming ticket gaming piece of FIG. 2.
Figure 4:
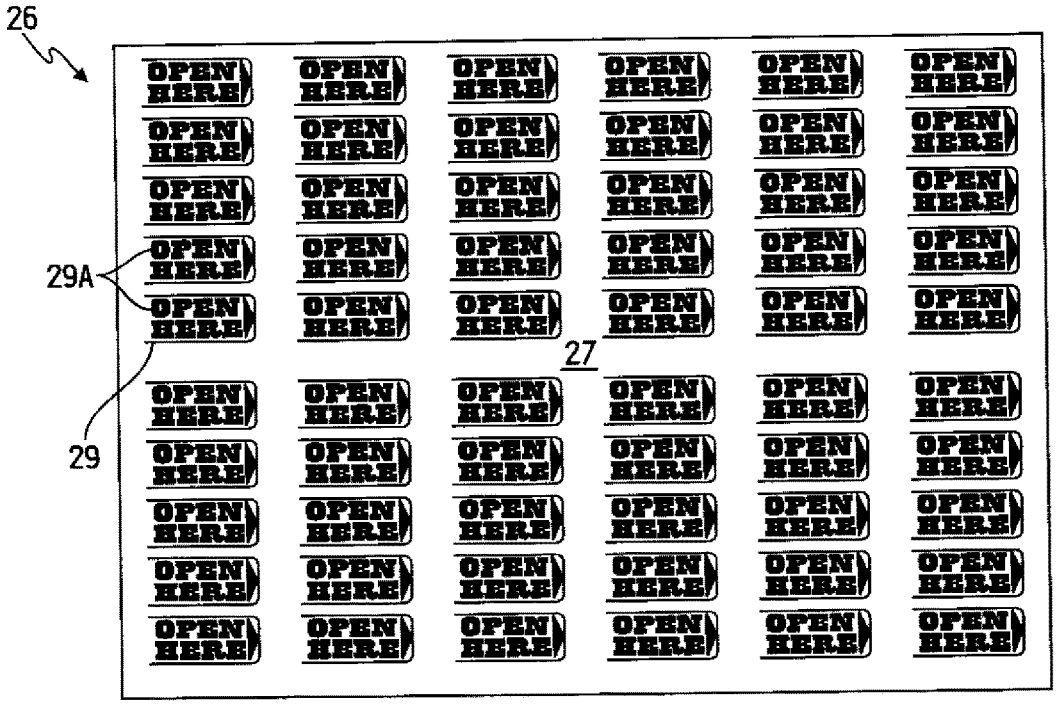
FIG. 4 depicts an illustrative covering piece of a gaming ticket.
Figure 5:
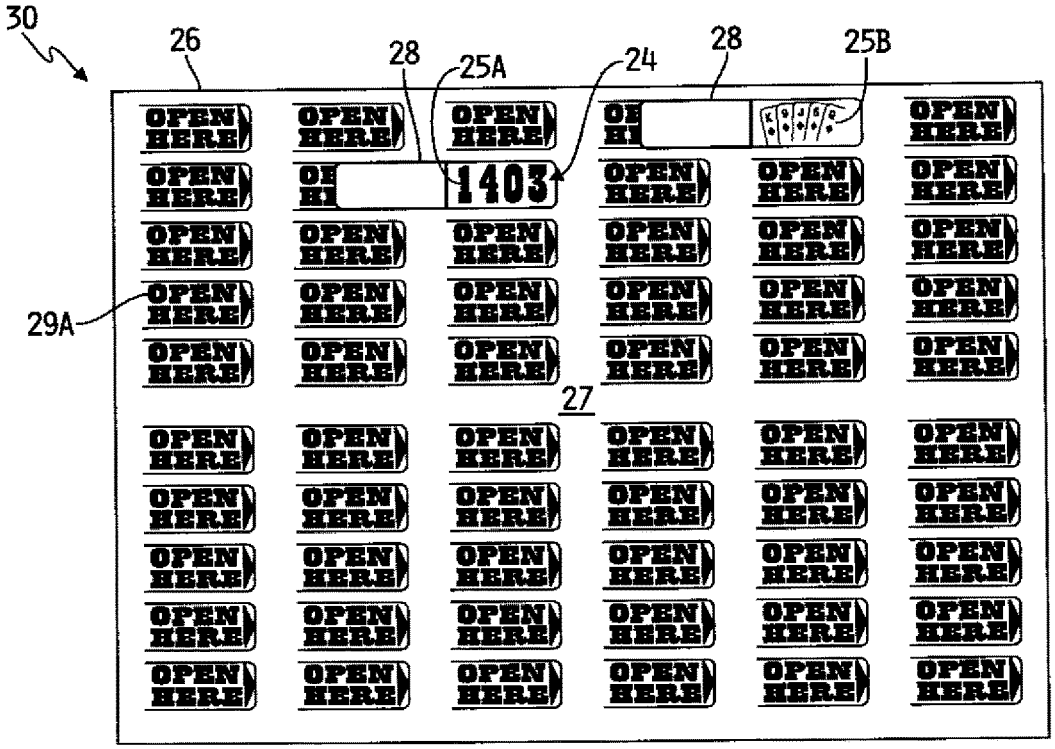
FIG. 5 depicts an illustrative gaming ticket comprising the gaming piece and the covering piece of FIGS. 2-4.
Figure 6:
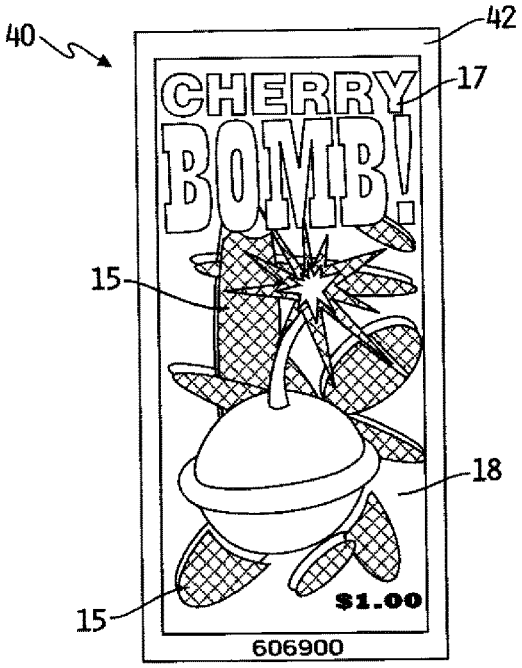
FIG. 6 depicts an illustrative obverse side of a spot-foil gaming ticket gaming piece.
Figure 7:
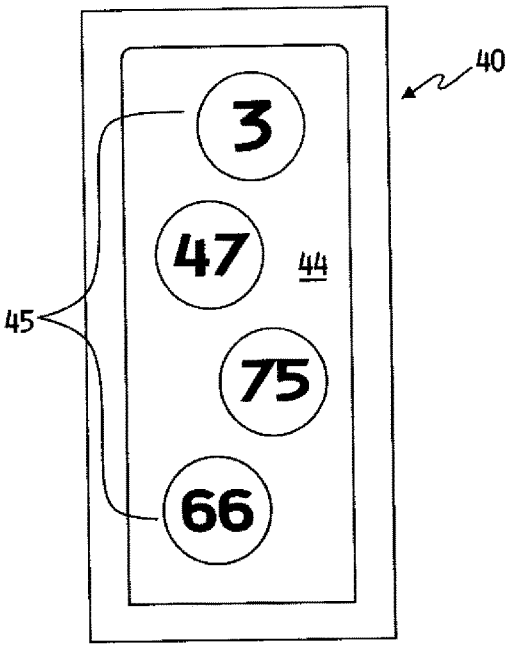
FIG. 7 depicts an illustrative reverse side of the gaming ticket gaming piece of FIG. 6.
Figure 8:
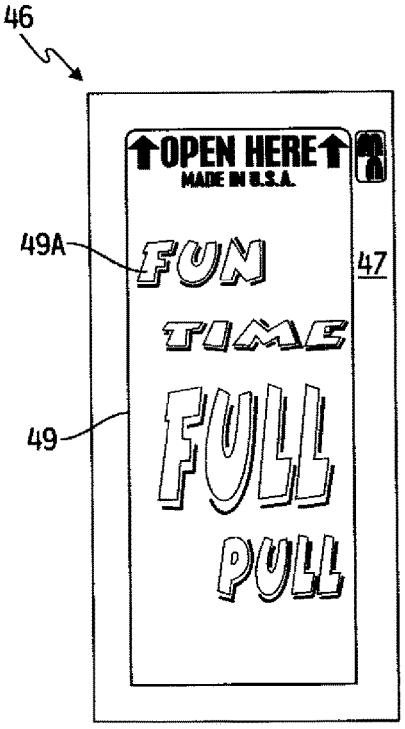
FIG. 8 depicts an illustrative covering piece of a gaming ticket.

Thus, rather than laminating foil to paper and then blocking or masking the areas where foil is not desired, the illustrative invention spot-foils the gaming ticket 30, 50. More specifically and illustratively, a gaming piece 20, 40 and a covering piece or Bristol 26, 46 are laminated together. The gaming piece 20, 40 illustratively comprises two sides, a first or obverse side 22, 42 (FIGS. 2 and 6) referred to as the game or gaming face 22, 42, and a second or reverse side 24, 44 (FIGS. 3, 7 and 9) generally comprising one or more characters referred to as play combination(s) or gaming combination(s) 25A, 25B, 45. The covering piece 26, 46 (FIGS. 4, 5, 8 and 9) which illustratively is a Bristol sheet known to those skilled in the art, also comprises two sides; namely, a first or obverse side 27, 47 (FIGS. 4, 5, 8 and 9), which illustratively may but need not have characters, such as the illustrative "OPEN HERE" characters 29A or "FUN TIME FULL PULL" characters 49A, printed thereon, and a second or reverse side 28, 48 (FIGS. 5 and 9), which illustratively is rendered generally opaque as for example and without limitation by the use of black Bristol. The gaming piece 20, 40 and the covering piece 26, 46 illustratively are joined together with their respective reverse sides 24, 28 and 44, 48 facing inwardly toward and abutting one another and their respective obverse sides 22, 27 and 42, 47 facing outwardly away from one another in order to form the illustrative gaming or pull tab ticket 30, 50. When so joined, the game face 22, 42 (FIGS. 2 and 6) and the illustrative "open here" 27 (FIGS. 4 and 5) or "full pull" 47 (FIG. 8) face are visible to a player or user. Illustratively, the gaming piece 20, 40 will have the gaming combination 25A, 25B, 45 printed on its reverse side 24, 44 prior to being joined with the covering piece 26, 46. The gaming face 22, 42 may also, but need not be printed on the obverse side 22, 42 prior to lamination. Similarly, characters may but need not be printed on the obverse side 27, 47 of the covering piece 26, 46, if at all, prior to, or after lamination as desired.

The perforations 29, 49 may be cut, or "kiss cut," prior to, or after lamination as desired. After lamination, a suitable adhesive is applied to the portions of the gaming ticket 50 where foil is desired to be deposited during the spot-foil process. Adhesives may include for example and without limitation glue, cement, and the like including for example a fast-drying UV glue. Foil may be applied to the spot(s) or portion(s) where the adhesive has been applied. The glue may be subjected to curing if desired. The foil may be applied to either or both of the gaming piece and the covering piece and may serve to mask the gaming combinations if desired. A varnish may also be applied it the game face if desired.

In one illustrative embodiment, illustratively a laminated sheet comprising a gaming piece 20, 40 and a covering sheet 26, 46 are passed through a die cutter and then passed through a printer, such as for example an ink-jet printer where the ticket 50 is serialized on the game face and then the gaming ticket 50 is flipped and the "open here" windows 29, 49 are formed or defined by kiss cutting the perforations 29A, 49A into the covering sheet 26, 46. The sheet 50 illustratively is flipped and an adhesive such as for example and without limitation a fast-drying UV-glue is applied to one or more spots or portions of the gaming face 22, 42. If desired, the gaming sheet 50 may illustratively be flipped again and adhesive applied to one or more spots or portions of the obverse side 27, 47 of the covering piece 26, 46, with foil being applied thereafter. So too, the adhesive could have been applied to the covering piece prior or just after the kiss cutting and prior to being applied to the gaming face if desired or even if at all. The gaming ticket 50 may be subjected to a curing station after the foil is applied. If desired, a varnish may be applied to the gaming face 22, 42 and/or the covering sheet 26, 46.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A gaming ticket comprising:

a gaming piece having a gaming combination; the gaming piece comprising a game face side and an opposing reverse side;

a covering piece coupled together with the gaming piece to conceal the gaming combination, the covering piece comprising a first side and an opposing second side; and a plurality of foil portions coupled to at least one of the game face side, the opposing reverse side, the first side and the second side, wherein the plurality of foil portions are spaced-apart from each other on the at least one of the game face side, the opposing reverse side, the first side and the second side and are spatially separated from any portion of the gaming ticket that conceals a gaming combination on said at least one of the game face side, the opposing reverse side, the first side and the second side; and wherein at least a portion of the foil portions comprise graphics.

2. The gaming ticket of claim 1, wherein the plurality of foil portions are coupled to the gaming piece and the covering piece.

3. The gaming ticket of claim 1, further comprising adhesive applied to a side of the at least one of the gaming piece and the covering piece.

4. The gaming ticket of claim 3, wherein the plurality of foil portions are positioned on the adhesive.

5. The gaming ticket of claim 3, wherein the adhesive is UV glue.

6. The gaming ticket of claim 1, wherein the plurality of foil portions each include a heat-activated adhesive agent.

7. The gaming ticket of claim 1, wherein the plurality of foil portions are coupled to at least one of the game face side and the first side.

8. The gaming ticket of claim 1, wherein the plurality of foil portions are coupled to at least one of the opposing reverse side and the second side.

9. The gaming ticket of claim 1, wherein at least a portion of the graphics comprise ink.

10. The gaming ticket of claim 1, wherein the graphics consist of letters and numbers.

11. A gaming ticket comprising:

a gaming piece having a gaming combination; the gaming piece comprising a game face side having a surface area and an opposing reverse side;

a covering piece coupled together with the gaming piece to conceal the gaming combination, the covering piece comprising a first side and an opposing second side; and a foil portion selectively coupled to only a portion of at least one of the game face side, the opposing reverse side, the first side and the second side, wherein the foil portion is smaller than each of the surface area of the game face side, the opposing reverse side, the first side and the second side, and wherein the foil portion is spatially separated from any portion of the gaming ticket that conceals a gaming combination on said at least one of the game face side, the opposing reverse side, the first side and the second side; and wherein at least a portion of the foil portion comprises graphics.

12. The gaming ticket of claim 11, wherein generally the entire foil portion is visible to a user.

13. The gaming ticket of claim 11, further comprising an adhesive applied to an obverse side of the at least one of the gaming piece and the covering piece such that the foil portion is coupled to the adhesive.

14. The gaming ticket of claim 11, wherein the foil portion includes a heat-activated adhesive agent.

15. The gaming ticket of claim 11, further comprising a varnish applied to an obverse side of the gaming piece.

16. The gaming ticket of claim 11, further comprising a second foil portion coupled to the at least one of the gaming piece and the covering piece, wherein the second foil portion is smaller than the surface area of each of the gaming piece and the covering piece.

17. A method of producing a gaming ticket comprising:

providing a gaming ticket comprising a game face side having a surface area and an opposing reverse side;

selectively applying foil graphics to only spaced portions of one of the game face side and the opposing reverse side of the gaming ticket, the spaced portions of the one of a game face side and the opposing reverse side of the gaming ticket being smaller than the surface area of the side of the gaming ticket to which the foil graphics have been applied and the spaced portions being spatially separated from any portion of the gaming ticket that conceals a gaming combination.

18. The method of claim 17, further comprising applying foil to a separate portion of the gaming ticket spaced-apart from the spaced portions of the gaming ticket, wherein the separate portion is separate and apart from any portion of the gaming ticket that conceals a gaming combination.

19. The method of claim 17, wherein applying foil includes applying foil to the game face side of the gaming ticket.

20. The method of claim 17, further comprising applying an adhesive to a portion of the gaming ticket that is smaller than the surface area of the gaming ticket, and wherein applying foil to a portion of the gaming ticket includes applying foil to the adhesive.

21. The method of claim 20, wherein the adhesive comprises UV glue and further comprising curing the glue.

22. The method of claim 21, further comprising applying a varnish to one or both sides of the gaming ticket.

23. The method of claim 17, further comprising laminating a covering piece of the gaming ticket and a gaming piece of the gaming ticket together.

24. The method of claim 23, wherein applying foil to a portion of the gaming ticket includes applying foil to a portion of the gaming ticket after laminating the covering piece and the gaming piece together.

25. The method of claim 17, further comprising activating a heat-activated adhesive contained within the foil to adhere the foil to the portion of the gaming ticket.

26. The method of claim 25, wherein activating the heat-activated adhesive includes heating a die to approximately 250° F. and pressing the heated die against the foil and the portion of the gaming ticket.

* * * * *